United States Patent [19]

Camps Mestre et al.

[11] 3,957,064

[45] May 18, 1976

[54] MOUTHPIECES TO FACILITATE GIVING UP SMOKING

[76] Inventors: Don Jose Maria Camps Mestre; Don Manuel Tremoleda Dilmer, both of Calle Londres No. 27, Barcelona, Spain

[22] Filed: Apr. 15, 1975

[21] Appl. No.: 568,185

[30] Foreign Application Priority Data

Apr. 19, 1974 Spain ..... 425730

[52] U.S. Cl. ..... 131/171 A; 131/10.3; 131/10.5

[51] Int. Cl.[2] ..... A24F 1/10; A24F 47/00

[58] Field of Search..... 131/170 A, 171 A, 198, 131/198 A, 182, 10.5, 10.3

[56] References Cited

UNITED STATES PATENTS

| | | | |
|---|---|---|---|
| 851,773 | 4/1907 | Pfortner | 131/198 R |
| 3,270,751 | 9/1966 | Tucker | 131/198 A |
| 3,359,988 | 12/1967 | Thomson | 131/10.3 |
| 3,428,050 | 2/1969 | Kandel | 131/10.3 |
| 3,441,028 | 4/1969 | Wall | 131/10.3 |
| 3,810,476 | 5/1974 | Thomas | 131/171 A |
| 3,812,865 | 5/1974 | Anderson | 131/171 A |

FOREIGN PATENTS OR APPLICATIONS

| | | | |
|---|---|---|---|
| 5,612 | 1894 | United Kingdom | 131/198 A |

*Primary Examiner*—Robert W. Michell
*Assistant Examiner*—V. Millin
*Attorney, Agent, or Firm*—Holman & Stern

[57] ABSTRACT

An improvement to a mouthpiece to facilitate giving up the smoking habit is disclosed wherein the sole locations of direct contact between the diluting body and the metallic sleeve is a pair of peripheral ribs on the diluting means.

7 Claims, 4 Drawing Figures

MOUTHPIECES TO FACILITATE GIVING UP SMOKING

BACKGROUND OF THE INVENTION

The present invention refers to improvements introduced in the mouthpieces which are used to facilitate giving up the smoking habit.

More concretely, the invention refers to mouthpieces of the kind which comprise an external air inlet, adjustable between zero and a maximum, which permits mixing the smoke drawn in by the smoker with a variable proportion of fresh air, reducing the toxicity of the mixture, and permitting the metabolism of the smoker to habituate itself with minimum effort to progressively decreasing nicotine levels.

Still more concretely, the invention refers to mouthpieces of the type which comprise a diluting body provided with an axial bore through which circulates the smoke coming from the cigarette, and is provided with at least one opening communicating with the exterior, whose effective dimensions can be regulated by screwing to a greater or lesser degree a regulating body into the diluting body, so that the proportion of fresh air coming from the outside, which in each case is mixed with the smoke drawn in by the smoker, can be regulated with full precision and in a perfectly safe manner.

To conceal said inlet orifices for the outside air from sight, it is normal, in the mouthpieces of the type referred to, to provide a metal sleeve, which envelops the diluting body, and which forms at its end the pan or housing in which fits the end of the cigarette to be consumed. It is also normal that the sleeve piece is mounted so that it can shift between limits, in an axial direction, with respect to the axially pierced stem which fixes it to the end of the diluting body, constituting an ejecting device. The circulation of outside air toward the orifice or orifices provided in the diluting body occurs through the annular chamber defined by the clearance between it and the metal sleeve surrounding it. This arrangement greatly complicates the mounting, making it necessary to manufacture this assembly with exceptional precision, and moreover, brings about a rapid aging in the outward appearance of the mouthpiece, as the friction which inevitably occurs between the edge of the sleeve — which is completely cantilever mounted — and the surface of the diluting body containing the air inlet orifices, causes the scoring of this piece, which is normally made of anodized aluminum or having any other suitable finish.

OBJECTS AND SUMMARY OF THE INVENTION

The aforesaid drawbacks, the practical importance of which is evident, are precisely remedied by the improvements which are the object of the present invention. According to one essential characteristic of these improvements, in fact the diluting body, which includes the air passage orifices presents at least two peripheral ribs, on which fits the metallic sleeve which constitutes the expelling mechanism. These two ribs are provided with openings, for example, three, regularly spaced, adapted to permit the passage of air toward said orifices and to ensure a certain pressure equilibrium, avoiding the production of bothersome noises when suction occurs. In these conditions it is obtained, on one hand, that the circulation of air toward the axial bore of the mouthpiece, through which the circulation of the smoke from the cigarette toward the smoker's mouth takes place, is always ensured, the concealment of the outer inlet orifices through the displaceable sleeve being also ensured. On the other hand, friction of the sleeve on the diluting body which it envelops occurs only on the two pheripheral ribs, so that no scoring effect can occur.

BRIEF DESCRIPTION OF THE DRAWINGS

The improvements of the invention can be understood more easily with reference to the annexed drawings presenting a preferred embodiment of the invention.

In the drawings.

DETAILED DESCRIPTION OF A PREFERRED EMBODIMENT

Figure 1:
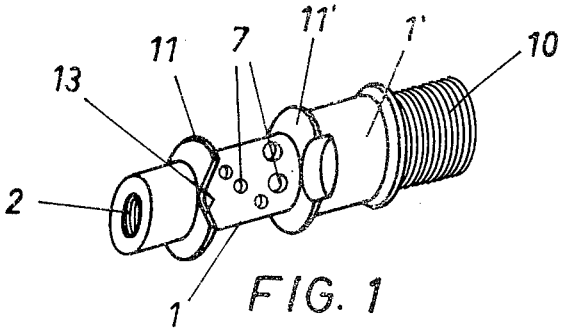
FIG. 1 is a view in perspective of the piece which has the outer air inlet orifices and the peripheral guide ribs, and which constitutes the essential element of the system.

Referring now to these drawings and according to the invention:

The mouthpiece comprises diluting body 1 provided with an axial bore 2 through which circulates the smoke coming from the cigarette toward the smoker's mouth, and in which is produced the mixture of this smoke with a variable and adjustable proportion of fresh outside air (FIG. 1). The diluting body 1 may be manufactured, for example, from cast aluminum, machined aluminum, plastic or plastic extruded on an aluminum core.

Figure 2:
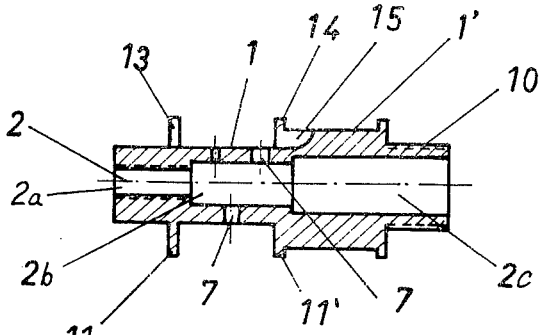
FIG. 2 is a cross-sectional view of FIG. 1.
Figure 3:
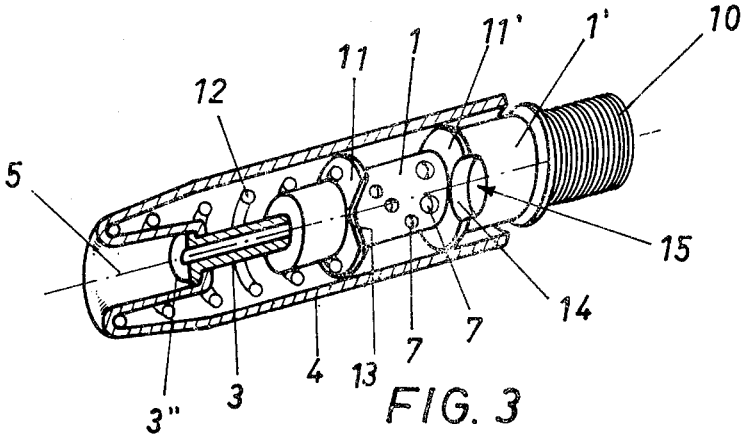
FIG. 3 shows the piece mounted in a cross-sectioned metallic sleeve which envelops it.
Figure 4:
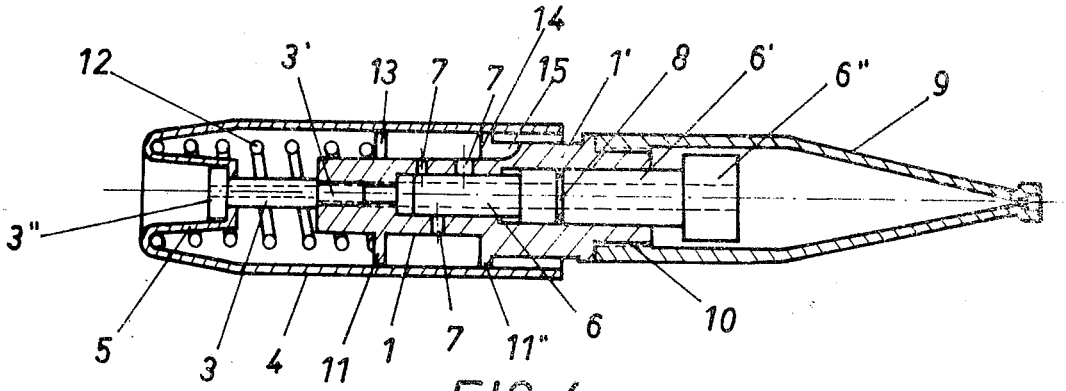
FIG. 4 is a longitudinal cross-section of the entire assembly of the mouthpiece.

The axial bore 2 of the diluting body 1 presents three zones of progressively increasing cross-section 2*a*, 2*b*, 2*c* (FIG. 2). The first of these zones 2*a* of least diameter, is internally threaded and is adapted to receive the threaded end 3' of the stem 3 (FIG. 3), axially perforated and provided at its opposite end with a head 3'', whereby one effects the fastening of the metallic sleeve 4, which envelops the diluting body 1, and which forms the end pan 5, to grip the cigarette which is to be consumed. The intermediate zone 2*b* of said axial bore 2 is also internally threaded and is adapted to permit the coupling of the externally threaded end portion of the restricting body 6 (FIG. 4). Into this zone 2*b* opens a series of orifices 7 for entrance of fresh outside air, arranged along one or more helical alignments, having progressively increasing sizes and terminating in a peripheral alignment of orifices of large size (FIG. 1). As the axial position of the hollow bore restricting body 6 in the interior of zone 2*b* is changed, a greater or smaller number of orifices 7 is restricted, bringing about a corresponding change in circulation of outside air into the interior of the mouthpiece. Specifically, from the position where the restricting body 6 is screwed all the way in, i.e., where all of said orifices 7 are restricted, unscrewing the restricting body 6 progressively opens the orifice 7. Thus, the axial displacements of equal amounts of the restricting body 6 are translated into increases of progressively increasing amounts of the total effective air inlet aperture. And, lastly, in the end zone 2*c* of the axial bore 2, being slidably fitted, is the intermediate zone 6' of the restricting body, which has a peripheral groove in which fits an elastic ring 8. The elastic ring 8, by pressing against the walls of the end zone 2*c*, prevents the restricting body 6 from being unintentionally unscrewed. The restricting body 6 has a protruding portion 6'', of maximum diameter, which extends beyond the diluting body 1, adapted to be easily secured, in view of the corresponding operations of screwing and unscrewing. This protruding portion 6'' is hidden by the end body 9, which is mounted on the threaded neck 10 provided at one end of the diluting body 1, and which is adapted to be partially introduced into the smoker's mouth adopting for that purpose any suitable anatomical form.

The metallic sleeve 4 fits on the peripheral ribs 11–11', provided on the diluting body 1. The diameter of the diluting body 1 enlarges into zone 1' between rib 11' and the threaded end 10. The sleeve 4 is adapted to slide between limits in an axial direction, guided by the ribs 11, 11' and by the stem 3, and it is constantly urged to adopt a limit position projecting to the maximum by the action of a helical spring 12, which rests against the rib 11. It should be noted that in these axial movements, the sleeve 4, guided in the manner set forth, although it presents a very small clearance with respect to zone 1' of diluting body 1, can never come in contact with this zone and therefore cannot score it or cause the least imperfection thereon. The rib 11 contains notches 13, for example three, regularly distributed, adapted, not only to reduce the friction surface between this rib and the sleeve, but also to permit the circulation of air, ensuring a pressure equilibrium which avoids the production of bothersome noises when suction occurs. Rib 11', in turn, also contains openings 14, also preferably three, regularly spaced, which match with cutouts 15 in zone 1'. The openings 14 and the cutouts 15 ensure a free circulation of fresh exterior air to annular chamber defined by the clearance existing between the diluting body 1 and the sleeve 4, and, from this chamber, through the orifices 7, toward the axial smoke circulation duct. It should especially be noted that the circulation of air is assured, despite the provision of a minimum clearance between sleeve 4 and zone 1' of piece 1, which has a very favorable effect on the aesthetic appearance of the whole of the mouthpiece, and despite any lack of precision that might be incurred in the manufacture or mounting.

What is claimed is:

1. A mouthpiece to facilitate giving up smoking having:

a diluting means for diluting smoke and air with additional air having an axial bore with at least one opening from said bore to the exterior of said diluting means;

a restricting means for restricting said opening movably mounted in said bore and extending axially beyond said bore;

a metallic sleeve enveloping said diluting means, moveably mounted on said diluting means, and defining a recess adapted to hold a tobacco source; and an end body connected to said diluting means and adapted to be partially introduced into a smoker's mouth;

the improvement comprising the diluting means being a body with an axial bore having three zones of differing diameters, the first zone being the least diameter and internally threaded for attaching an axially bored stem for mounting said metallic sleeve to said diluting means, the second zone being internally threaded for mounting said restricting means and containing said opening in the form of an axially-spaced plurality of orifices, the third zone being of largest diameter and having a smooth bore; two peripheral ribs on the exterior of said body, said ribs being the sole external contact locations for the mounting of said metallic sleeve; said plurality of orifices opening into the space defined between said ribs, and the rib closest to said third zone having at least one cutout through which said additional air can enter the annular space between said metallic sleeve and said body to dilute smoke from the tobacco source.

2. The mouthpiece as claimed in claim 1, wherein said restricting means comprises a cylinder having an axial bore having three portions of differing diameter, the first portion being the least diameter being threaded and adapted to be screwed into and out of said second zone of said diluting means thereby restricting a variable number of said plurality of orifices, the second portion being adapted to slide in said third zone of the diluting means and the third portion extending beyond said diluting means and being shaped so as to be easily rotatable and being enveloped by said end body when no rotary adjustments are being made.

3. The mouthpiece as claimed in claim 2 wherein the external shape and juxtaposition of said metallic sleeve and said end body create a substantially continuous smooth cylinder tapering towards the shaped body end and said metallic sleeve and end body having a small axial space therebetween for the entry of diluting air.

4. The mouthpiece as claimed in claim 1, wherein said body of said diluting means is provided with cavities on its exterior adjacent to said at least one cutout.

5. The mouthpiece as claimed in claim 1, wherein said rib on said body of said diluting means closest to said first zone is provided with notches to decrease the surface area of contact between said rib and said metallic sleeve thereby reducing the friction between said rib and said metallic sleeve during movement of said sleeve.

6. The mouthpiece as claimed in claim 1 wherein said plurality of axial spaced orifices are helically oriented in said second zone and have progressively increasing diameters towards the third zone.

7. The mouthpiece as claimed in claim 1 further comprising a spring biasing said metallic sleeve axially away from said diluting means.

* * * * *